US008021282B2

(12) United States Patent
Polevoy et al.

(10) Patent No.: US 8,021,282 B2
(45) Date of Patent: Sep. 20, 2011

(54) EXERCISE DEVICE

(75) Inventors: Richard S. Polevoy, Teaneck, NJ (US); Paul E. Carlson, Skaneateles, NY (US)

(73) Assignee: Finger Lakes Intellectual Property LLC, Teaneck, NJ (US)

( * ) Notice: Subject to any disclaimer, the term of this patent is extended or adjusted under 35 U.S.C. 154(b) by 0 days.

(21) Appl. No.: 12/156,952

(22) Filed: Jun. 5, 2008

(65) Prior Publication Data

US 2009/0062085 A1 Mar. 5, 2009

(51) Int. Cl.
*A63B 21/075* (2006.01)
*A63B 21/06* (2006.01)

(52) U.S. Cl. ..... 482/108; 482/93

(58) Field of Classification Search ..... 482/49, 482/50, 106–109, 93; D21/680–682
See application file for complete search history.

(56) References Cited

U.S. PATENT DOCUMENTS

| | | | | | |
|---|---|---|---|---|---|
| 560,517 | A * | 5/1896 | Metzger | 482/108 |
| 777,478 | A * | 12/1904 | Minor | 482/93 |
| 1,229,658 | A * | 6/1917 | Sandow | 482/50 |
| 1,917,566 | A * | 7/1933 | Wood | 482/108 |
| 3,467,376 | A * | 9/1969 | Feinberg | 273/452 |
| 4,431,185 | A * | 2/1984 | Cisneros | 482/93 |
| 5,496,244 | A * | 3/1996 | Caruthers | 482/108 |
| 6,387,022 | B1 * | 5/2002 | Smith | 482/106 |
| 6,544,148 | B1 * | 4/2003 | Loew | 482/82 |
| 6,971,974 | B2 * | 12/2005 | Bowman et al. | 482/107 |
| 7,011,611 | B1 * | 3/2006 | Ripley | 482/107 |
| 7,052,445 | B2 * | 5/2006 | Ekhaus | 482/93 |
| 7,381,157 | B2 * | 6/2008 | Blateri | 482/50 |
| 7,491,157 | B1 * | 2/2009 | Lin | 482/108 |
| 2003/0096683 | A1 * | 5/2003 | Fenelon et al. | 482/107 |
| 2005/0003931 | A1 * | 1/2005 | Mills et al. | 482/5 |
| 2007/0117692 | A1 * | 5/2007 | Towley et al. | 482/107 |
| 2008/0081744 | A1 * | 4/2008 | Gormley | 482/93 |

* cited by examiner

*Primary Examiner* — Allana Lewin
(74) *Attorney, Agent, or Firm* — Klauber & Jackson LLC

(57) ABSTRACT

An improved exercise device in the nature of a kettlebell. The device has a frame covered by a shroud that is configured to lessen the impact of the device on the user. There are a plurality of weights that can be easily attached and detached from the frame to increase or lessen the load to the user. The weights are designed so that they can be added or taken away without altering the center of gravity of the device or the external physical shape of the device. There is also a base that holds the device while the weights are being changed and which also interacts with the device to assist in that exchange. The attaching and detaching system includes a pin that is used to affix the weights to the frame. A dual locking system assures that the pin does not inadvertently come loose during use of the device.

16 Claims, 9 Drawing Sheets

EXERCISE DEVICE

REFERENCE TO RELATED APPLICATIONS

The present patent application is based upon and hereby claims priority to U.S. Provisional Application Ser. No. 60/855,955 filed Nov. 1, 2006.

FIELD OF THE INVENTION

The present invention relates to an exercise device and, more particularly, to an adjustable kettlebell that utilizes specially designed weights.

BACKGROUND OF THE INVENTION

A kettlebell is a long used exercise with a handle. The kettlebell dates back to the early twentieth century and is attributed to a Russian heritage. The kettlebell comes in different weights, typically from 9 pounds to 90 pounds and is used as a weight lifting device to improve musculature, strength and coordination as well as reduce the risk of injury. One of the typical exercises with a kettlebell is to lift the device and, as the device is raised upwardly, to flip it over so as to rest on the back of the wrist of the user. It is different from a typical dumbbell because the mass of the kettlebell is cantilevered away from the grasp of the user's hand allowing for a dynamic load to the body as it is flipped over during the exercise.

The unique shape of the kettlebell allows a mass center to be located more distal to the joint than a dumbbell and the additional lever of the kettlebell, by placing a resistance distal to the handle, provides a unique challenge to the nervous systems well as the grip. As such, the user encounters much greater inertial forces and which may provide a distinct advantage when attempting to transfer swing gains to athletic tasks with a strong inertial component, such as baseball pitching, a golf swing, Olympic lifts etc.

One problem associated with the traditional kettlebells is that the device has a generally crude appearance that has remained relatively unchanged throughout its long history. The shape affects the comfort of the user while exercising, and in particular, in carrying out the basic exercise where the kettlebell is flipped over the handle and stopped on the back of the wrist, the ball shape and iron material can cause discomfort and bruising to the user especially to the beginner who has not mastered the technique.

Another problem associated with the traditional kettlebells is that each kettlebell had a specific weight, generally measured in kilograms, and therefore, the user requires multiple kettlebells with different weights to do a variety of exercises requiring a unit for each hand. For a trainer this means carrying and storing many different kettlebells with different weights and bulk.

There have been kettlebells disclosed with adjustable weights and which include round flat weights positioned perpendicular to the handle, round flat weights located parallel to the handle and the like. As an example, there is a kettlebell shown and described in U.S. Published Patent Application 2006/0035767 where the device has removable and replaceable weights.

However, even with the adding and subtracting of weights, making the overall weight adjustable, there are further problems in that the center of gravity moves with the change of the weights and which is not advantageous for the user where a uniform location of the center of gravity is desirable in optimizing the benefit of the exercise. In addition, the adding and subtracting of weights though current systems changes the size and shape of the kettlebell, again, an undesirable feature.

Others devices are constructed in uncomfortable and dangerous forms and, generally, there are difficulties in exchanging the weights quickly and problems in attaching the weights securely. Further problems include the lack of a convenient storage for the weights as well as difficulty in readily identifying the weight of the kettlebell after a change in weight.

Accordingly, it would, therefore, be desirable to have a kettlebell that overcomes the aforementioned difficulties and problems in existing kettlebells.

BRIEF SUMMARY OF THE INVENTION

Therefore, in accordance with the present invention, there is an exercise device, such as a kettlebell, that overcomes the problems and disadvantages of the aforedescribed prior art devices. With the present invention, the exercise device is a hand held device that has a frame that is generally a heavy metallic construction. There are a plurality of weights that can be attached to and detached from the frame and the weights are configured such each can be added to the frame or removed therefrom without altering the center of gravity of the overall exercise device.

To that end, the weights are generally coaxial, when nested together and are generally annular in configuration having different radii so that the weights can nest against each other. In the exemplary embodiment, there is an inner weight, an intermediate weight and an outer weight that nest together. As an enhanced feature, the weights are color coded so that the user can easily identify which weights are being used such that the determination of the overall weight of the exercise device is easy to recognize.

The present exercise device also has a shroud that covers the frame and which is designed to reduce the trauma of the device contacting the back of the wrist of the user in carrying out an exercise so as to minimize the impact and discomfort. Thus, the outer shroud of the exercise device has a curved surface that generally fits the contour of the back of the wrist as opposed to the current spherical configuration that does cause trauma to the user, particularly in the case of a novice attempting to learn the exercises. In addition, the presence of the shroud allows the present exercise device to have weights added or taken away while still retaining the same physical size and shape of the device.

There is a unique detaching and attaching system that allows the weights to be easily and quickly added and removed from the device. In carrying out that system, there is a pin that can be manipulated by the use of one hand and which can be slid in and out of the frame to add or remove a weight. The pin is held in its inserted position by a dual locking system, that is, there is a locking means having a toggle lever to hold the pin to the frame and also there is a shear force created that acts against the pin when in its operative, inserted position that also contributes to prevent the inadvertent removal of the pin. Both of the locking means of the dual locking system are readily disengaged by the user for easy removal for adding or removing of the weights.

As a further feature of the present invention, the is a base that is used to store the weights that are not being currently used in the exercise device and the base provides a ready means of storing the weights as well as facilitate the procedure of adding or removing of weights for the exercise device itself.

Finally, there is a handle that is securely affixed to the frame and the handle is a molded plastic, one piece grip that is seamless for comfort of the user in swinging the weight. The handle can be manufactured by various exemplary injection molding techniques.

These and other features and advantages of the present invention will become more readily apparent during the following detailed description taken in conjunction with the drawings herein.

DETAILED DESCRIPTION OF THE INVENTION

Figure 1:
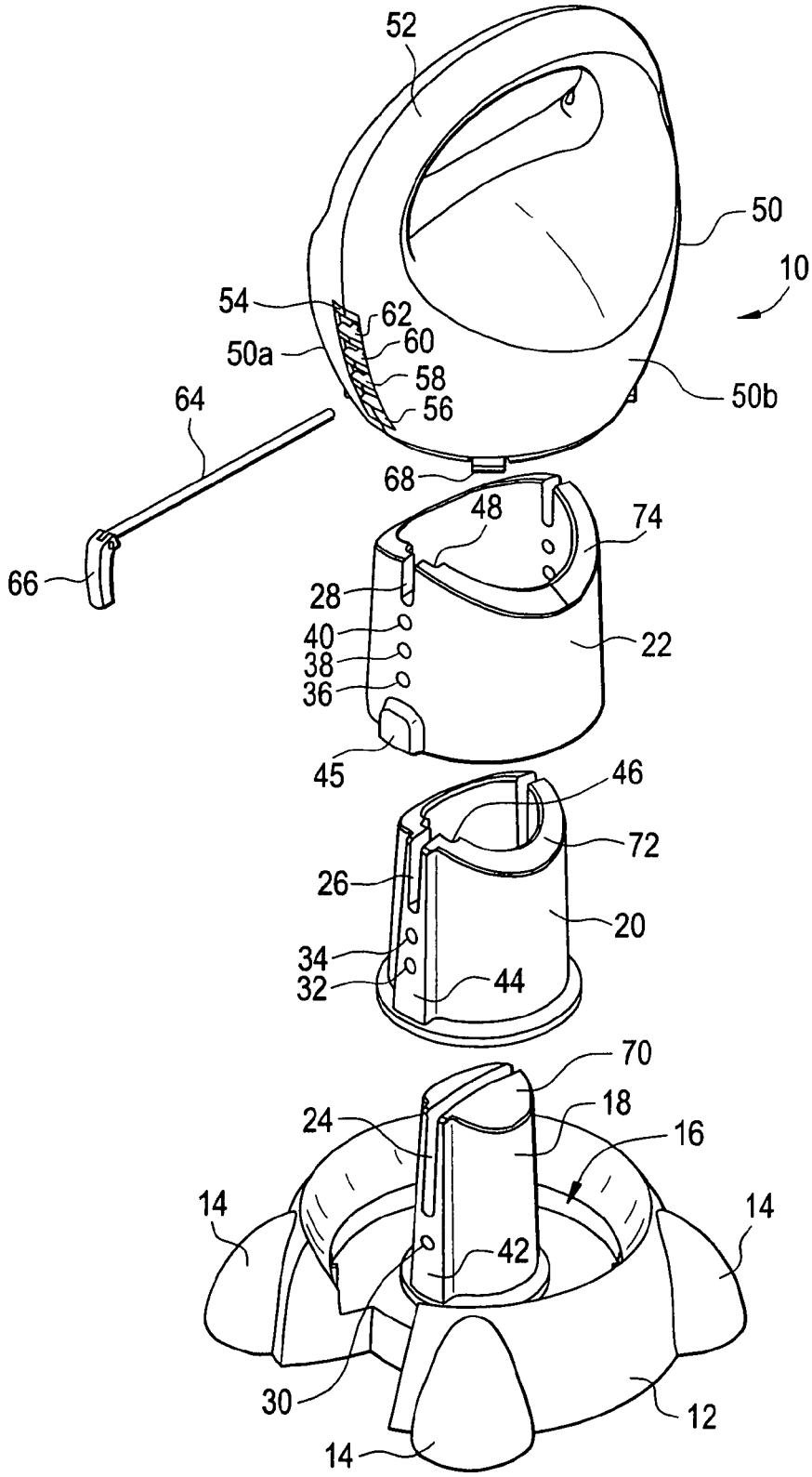
FIG. 1 is an exploded view of the exercise device and base constructed in accordance with the present invention.

Referring now to FIG. 1, there is shown an exploded view of the exercise device 10 constructed in accordance with the present invention along with its base 12. The interrelationship between the exercise device 10 and the base 12 will be later explained. Basically, the base 12 has pods 14, only three of which are shown in FIG. 1, so that the base 12 is adapted to sit firmly on a planar surface such as a floor. The base 12 can be a molded component and has a cavity 16 for supporting and storing a plurality of weights, that is, an inner weight 18, an intermediate weight 20 and an outer weight 22.

As can be seen, the weights 18, 20, and 22 are concentrically oriented and are shaped so as to be nestable within each other. As Such, the intermediate weight 20 fits over and nests to the inner weight 28 and, likewise, the outer weight 22 fits over and nests to the intermediate weight 20. While only three weights are illustrated, it can be understood that a greater or lesser number weights could be used consistent with the teaching of the present invention. Since the weights 18, 20, 22 are generally annular, all three have their centers of gravity located such that the center of gravity of the weights 18, 20, 22 remains at a fixed point whether there is only the outer weight 22, the outer and intermediate weights 22, 20 nested together or all three weights 18, 20, 22 nested together as will become understood.

The inner weight 12 has an elongated vertical slot 24 of a predetermined depth; the intermediate weight has a elongated vertical slot 26 of a lesser depth while the outer weight 22 has an elongated vertical slot 28 of a still lesser depth. There are also holes in each of the weights 18, 20 and 22 and are illustrated as lower hole 30 that passes entirely through the lower weight 18. In the intermediate weight 20, there is a lower hole 32 and an upper hole 34. In the outer weight 22, there is a lower hole 36, an intermediate hole 38 and an upper hole 40 and which are located at predetermine heights that are coordinated with each of the elongated vertical slots 24, 26, 28.

Accordingly, when all of the weights 18, 20, 22 are properly nested within each other, the lower holes 30, 32 and 36 are aligned with each other, the upper hole 34 of the intermediate weight 20 is aligned with the intermediate hole 38 of the outer weight 22 and which is located above the bottom of the elongated vertical slot 28 and the upper hole 40 of the outer weight 22 is located above the bottom of the elongated vertical slot 26.

Each of the weights 18 and 20 also has a vertical flange 42 and 44, slightly tapered outwardly in the downward direction, respectively, and which fit inside a inner slots 46, and 48 formed in the internal surface of the intermediate weight 20 and outer weight 22 and correspondingly dimensioned, so that the weights 18, 20 and 22 are properly aligned when they are nested together. There is also a smaller outwardly projecting flange 45 formed on the outer weight 22.

There further can be seen in FIG. 1, that the exercise device 10 has a shroud 50 comprised of half shrouds 50*a* and 50*b* affixed together to make up the shroud 50.

There is also a handle 52 that extends upwardly and which is designed to be grasped by the user in using the exercise device 10 to perform an exercise movement. In the exemplary embodiment, the handle 52 is a molded plastic, seamless construction so as to provide a comfortable surface to the user grasping that handle 52.

The handle 52 can preferably be produced as a one-piece handle by certain molding techniques. One exemplary technique is reaction injection molding where a foaming agent is introduced into the mold. As such, during the molding, the foaming agent creates bubbles to expand the plastic material and fill the mold. The resultant handle is comprised of a non-porous outer skin while the interior of the handle is comprised of a solid foam consistency.

Another molding technique that can be used to produce a one-piece handle for the present invention is compression molding wherein the plastic material is placed within the mold such that there is more plastic material than usable volume within the mold. As such, as the mold is closed, the mold pressurizes the molding material, thereby causing the plastic material to set while excess material is rejected outwardly from the sides of the mold.

A still further technique for producing the one-piece handle for the present invention is gas assisted injection molding. With this technique, a gas is introduced into the closed mold such the plastic molding material blows up by the formation of a large bubble within the material. The resultant handle is, therefore, a one piece handle with a large void remaining therein.

In the half shroud 50*b*, there is also an opening area 54 with four receiving openings 56, 58, 60 and 62 vertical spaced apart. A locking pin 64 is adapted to enter any of the four receiving openings 56, 58, 60 and 62 as will be later explained and there is a toggle lever 66 located at the proximal end of the locking pin 64.

There can also be seen in FIG. 1 a locking projection 68 located at the bottom of the shroud 50 and its purpose will be later explained. In the exemplary embodiment, there are four locking projections 68 (only one of which is shown in FIG. 1) and which are spaced about 90 degrees apart along that bottom area.

Also, in the exemplary embodiment, the upper surfaces 70, 72 and 74, respectively, of the inner weight 18, the intermediate weight 20 and the outer weight 22 are all tapered downwardly in the outer direction and, as will be seen, when the weights are nested together, those upper surfaces 70, 72 and 74 form a common, contiguous tapered surface.

Figure 2:
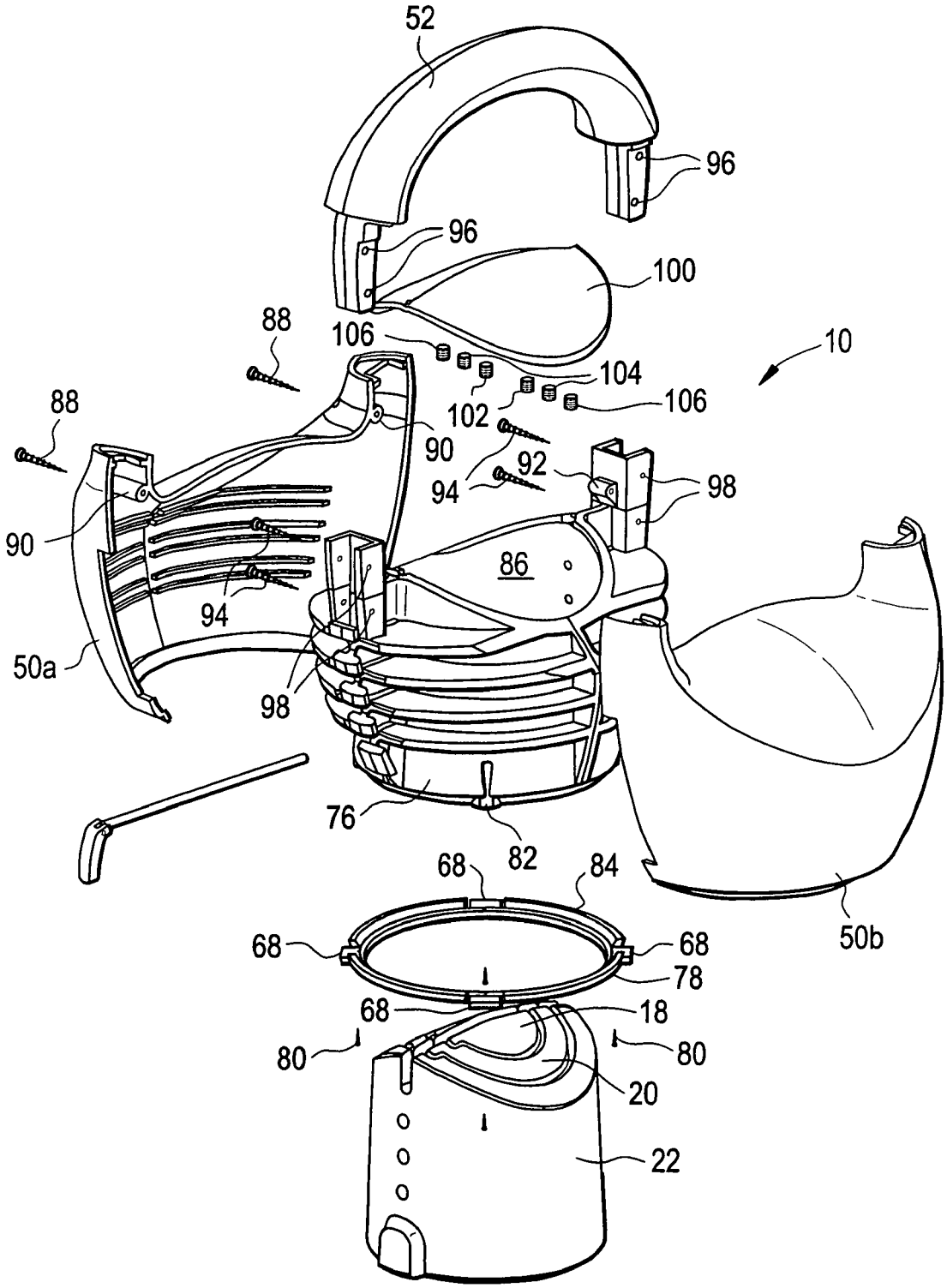
FIG. 2 is an exploded view of the exercise device of FIG. 1.

Turning now to FIG. 2, there is an exploded view of the exercise device 10 of the present invention. In FIG. 2, there is shown a frame 76 that can be made of a heavy material, such as cast iron, a heavy plastic or the like. The cast iron frame 76 may be constructed as a one piece unit or may be cast in two or more pieces and secured together. At the bottom of the frame 76, there is a metal ring 78 affixed to the frame 76 by means such as screws 80 that are threaded into small bosses 82 (only one of which is shown) formed at the bottom of the frame 76. The metal ring 78 has an outer peripheral flange 84 that extends upwardly and slightly outwardly along the outer edge of the metal ring 78. As also can be seen, there are the four locking projections 68 formed in the ring 78 and which have tapering surfaces that are slanted or non-horizontal surfaces The frame 76 has an open area 86 that is dimensioned so as to receive the weights 18, 20, 22. The half shrouds 50*a* and 50*b* are affixed to the frame 76 and may be affixed thereto by means of screws 88 that pass through bosses 90 formed in the half shroud 50*a* and pass through a projecting boss 92 on the frame 76 (only one of which is shown) and threaded into threads formed in bosses (not shown) provided in the half shroud 50*b*.

The handle 52 is also secured to the frame 76 and that securing may be by means of screws 94 that pass through vertically spaced apart sets of holes 96 in the handle 52 and similarly located holes 98 in the frame 76 and thread into threads, for example, in the frame 76. There is also a cover 100 that is positioned atop of the frame 76 and which may be affixed thereto by a press fit or by some suitable fasteners.

There are sets of springs that create a bias between the weights 18, 20 and 22 and the cover 100 and, as shown, there are preferably three sets of springs, a set of inner springs 102, a set of intermediate springs 104 and a set of outer springs 106, each of which sets will be later shown to bias, respectively, against the inner weight 18, the intermediate weight 20 and the outer weight 22 to serve a purpose that will be later described. The sets of springs may be affixed to the underside of the cover 100 by means such as being pressed into bosses (not shown) in the cover 100 having cylindrical openings, however, other methods of affixing the sets of springs 102, 104 and 106 can be used.

As also shown in FIG. 2, the inner, intermediate and outer weights 18, 20, 22 are illustrated in their nested orientation such that the nesting within each other maintains the center of gravity in a fixed location no matter whether one, two or all three weights are being employed by the user. As a feature of the present invention, the weights 18, 20 and 22 are color coded so that the user can easily see what weights are being used with the exercise device 10 since the weights are readily visible from the bottom of the exercise device 10. Alternatively or in addition, there may be a window or opening at the upper surface of the exercise device 10 that would allow the user to look downwardly into the device in order to easily determine the colors of the weights then in use. Thus, the user can instantly know how much weight is being used in the exercise.

Figure 3:
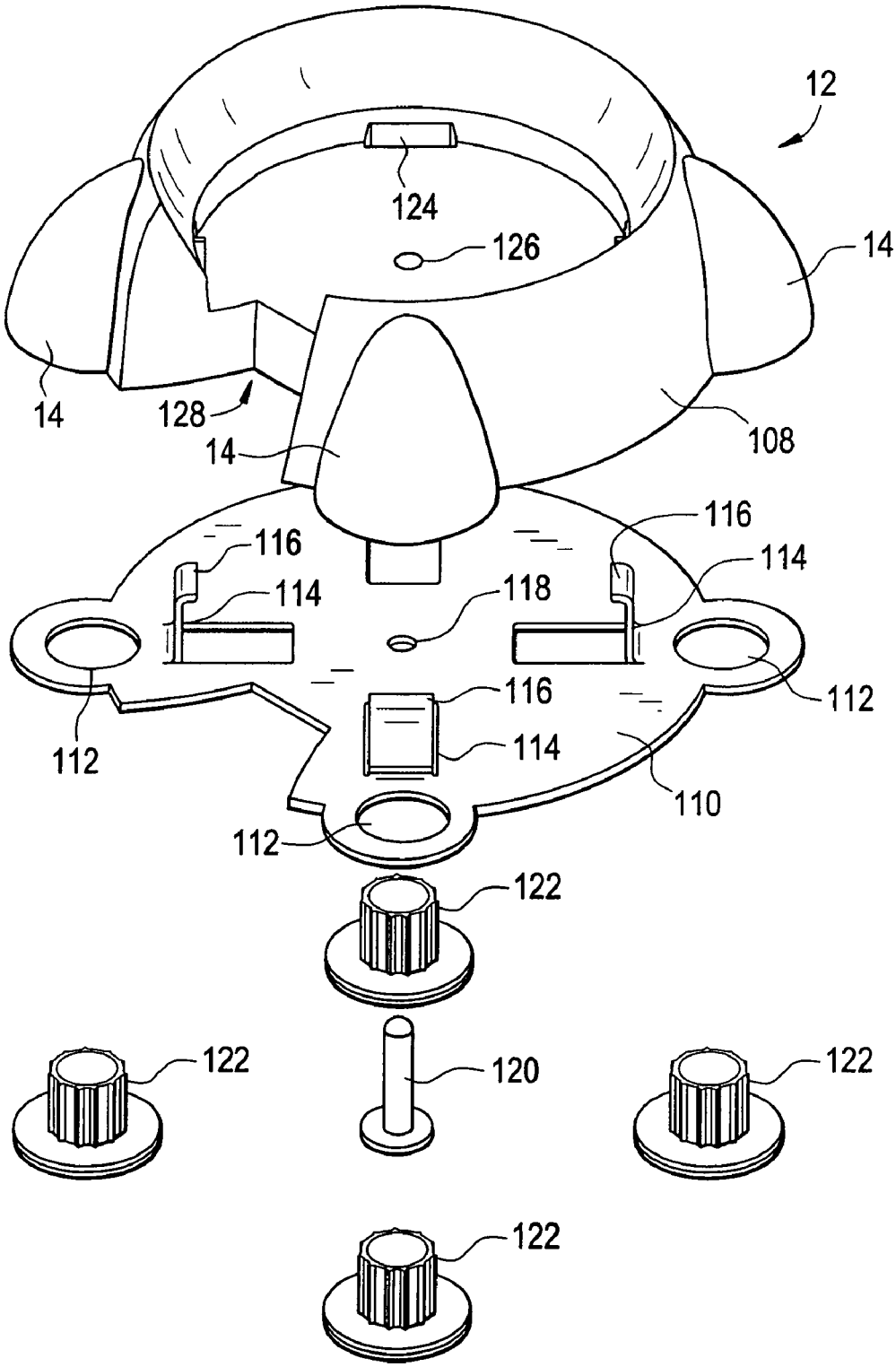
FIG. 3 is an exploded view of the base used with the exercise device.

Turning now to FIG. 3, there is shown, an exploded view of the base 12 that is a part of the present invention. As can be seen, the base 12 comprises a molded housing 108 and which may be comprised of a cosmetic plastic construction. At the bottom of the housing 108, there is a stamped base plate 110 having openings 112, and, in the exemplary embodiment, there are four openings 112 spaced about ninety degrees apart. The base plate 110 has upstanding locks 114 extending upwardly therefrom, again four are illustrated, and which have upper generally horizontal locking edges 116. There is a center hole 118 in the base plate 110 and which locates an alignment pin 120 that is used to align and center the weights 18, 20 and 22 (FIG. 2) when those weights are contained within the base 12.

Molded rubber feet 122 are also utilized and which can pass through the openings 112 and be press fitted into suitable holes (not shown) located in the lower surface of the pods 14 to retain the base plate 110 to the molded housing 108. Finally, there are slotted openings 124 formed in the molded housing 108 so that, when assembled, the upstanding locks 114 with the locking edges 116 extend upwardly through the slotted openings 124 and are therefore accessible for a purpose to be later explained. A central hole 126 is also provided in the molded housing 108 in alignment with the center hole 118 in the base plate 110. Finally, with respect to FIG. 3, there is a cut away area 128 formed in the periphery of the molded housing 108 and, again the purpose of the cut away area 128 will later become clear.

Figure 4:
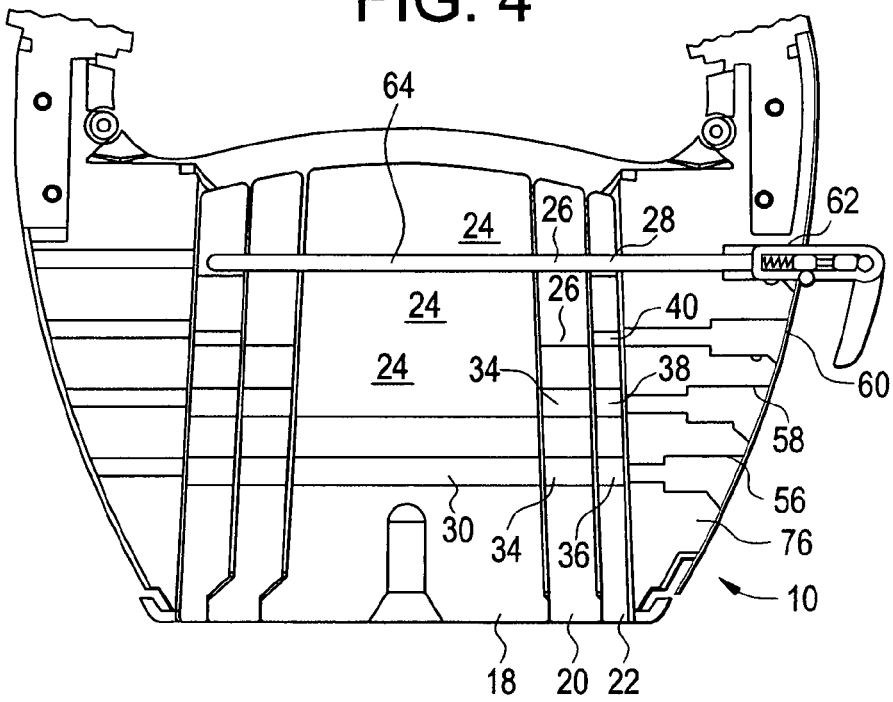
FIG. 4 is a side cross-sectional view of the exercise device of the invention.

Turning now to FIG. 4, taken along with FIGS. 1 and 2, there is a side cross-sectional view illustrating the attaching and detaching system used to change the weights that are lifted by a user of the exercise device 10. There are four receiving openings 56, 58, 60 and 62 formed in the frame 76 and each of the receiving openings 56, 58, 60 and 62 is adapted to receive the locking pin 64 depending upon the desires of the user.

For example, if the user desires to have the frame 76 pick up all of the weights 18, 20, 22 the locking pin 64 is inserted by the user into the receiving opening 56 where the locking pin 64 then passes through the lower hole 36 in the outer weight 22, the lower hole 32 of the intermediate weight 20 and the lower hole 30 of the inner weight 18 such that the locking pin 64 has passed through all of the weights 18, 22 and 22 thereby attaching all of the weights 18, 20, 22 to the frame 76. Accordingly, when the user lifts the frame 76, it holds all of the weights or the maximum weight for the exercise device 10.

As an alternative, the user can insert the locking pin 64 into the receiving opening 58, whereupon the locking pin 64 then passes through the intermediate hole 38 of the outer weight 22 and the upper hole 34 of the intermediate weight 20 and the elongated vertical slot 24 of the inner weight 18 and thus only the intermediate weight 20 and the outer weight 22 become attached to the frame 76 such that now only those two weights are lifted as the user lifts the exercise device 10, thereby exercising with a lighter weight.

In a similar fashion, the user can select a still lesser load by inserting the locking 64 into the receiving opening 60, at which point the locking pin 64 passes through the upper hole 40 of the outer weight 22, the elongated vertical slot 26 of the intermediate weight 20 and the elongated vertical slot 24 of the inner weight 18 thereby only attaching the outer weight 22 to the frame 76 for lifting by the user.

Finally, by inserting the locking pin 64 through the receiving opening 62, the pin passes through the elongated vertical slot 28 of the outer weight 22, the elongated vertical slot 26 of the intermediate weight and the elongated vertical slot 24 of the inner weight 18 such that the user now is lifting only the weight of the frame 76 since none of the weights 18, 20 or 22 are attached to the frame 76 and, therefore, the user is lifting the lightest weight allowed by the exercise device 10.

There is a dual locking system to prevent the locking pin 64 from inadvertently becoming disengaged from its engaged position within one of the receiving openings and that dual locking system is carried out by two different methods and structure for locking the locking pin 64 into the particular receiving opening.

Figure 4A:
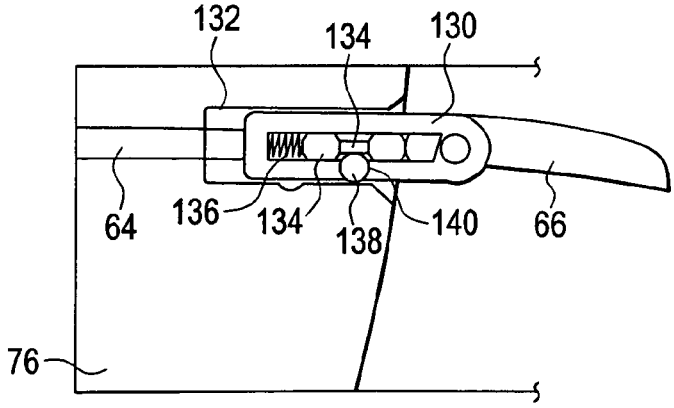
FIGS. 4A and 4B are side schematic views illustrating the locking system of the present invention.
Figure 4B:
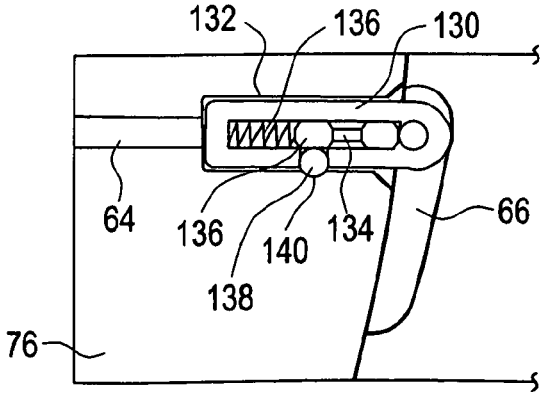

One locking means of the dual locking system is illustrated in FIG. 4 taken along with the enlarged side cross sectional views of FIGS. 4A and 4B. As can be seen, the locking pin 64 includes a housing 130 that enters an opening 132 in the frame 76. The housing 130 encloses a laterally movable piston 134 having an enlarged section 136. In FIG. 4A, the toggle lever 66 pushes the piston 134 by means of an off center mechanism, against the bias of a spring 136 to move the piston 132 to its leftmost position or unlocked position as shown in FIG. 4A.

A blocking member, such as a ball 138, is contained in an opening 140 in the housing 130. As such, when the toggle lever 66 is activated by a user, the piston 134 is released such that the spring 136 moves the piston 13 to the right or locked position and the ball 138 is forced outwardly by the enlarged section 136 of the piston 134 to enter into an annular depression 142 in the opening 132 to securely lock the housing 130 as well as the locking pin 64 itself, within the frame 76, thereby prevent the locking pin 64 from inadvertently slipping out of its locked position and potentially releasing one or more weights. As also can be seen, when the locking pin 64 is in its locked position, the toggle lever 66 rests closely against the exercise device 10 so as to not snag the user's clothing or other impediments.

Figure 5:
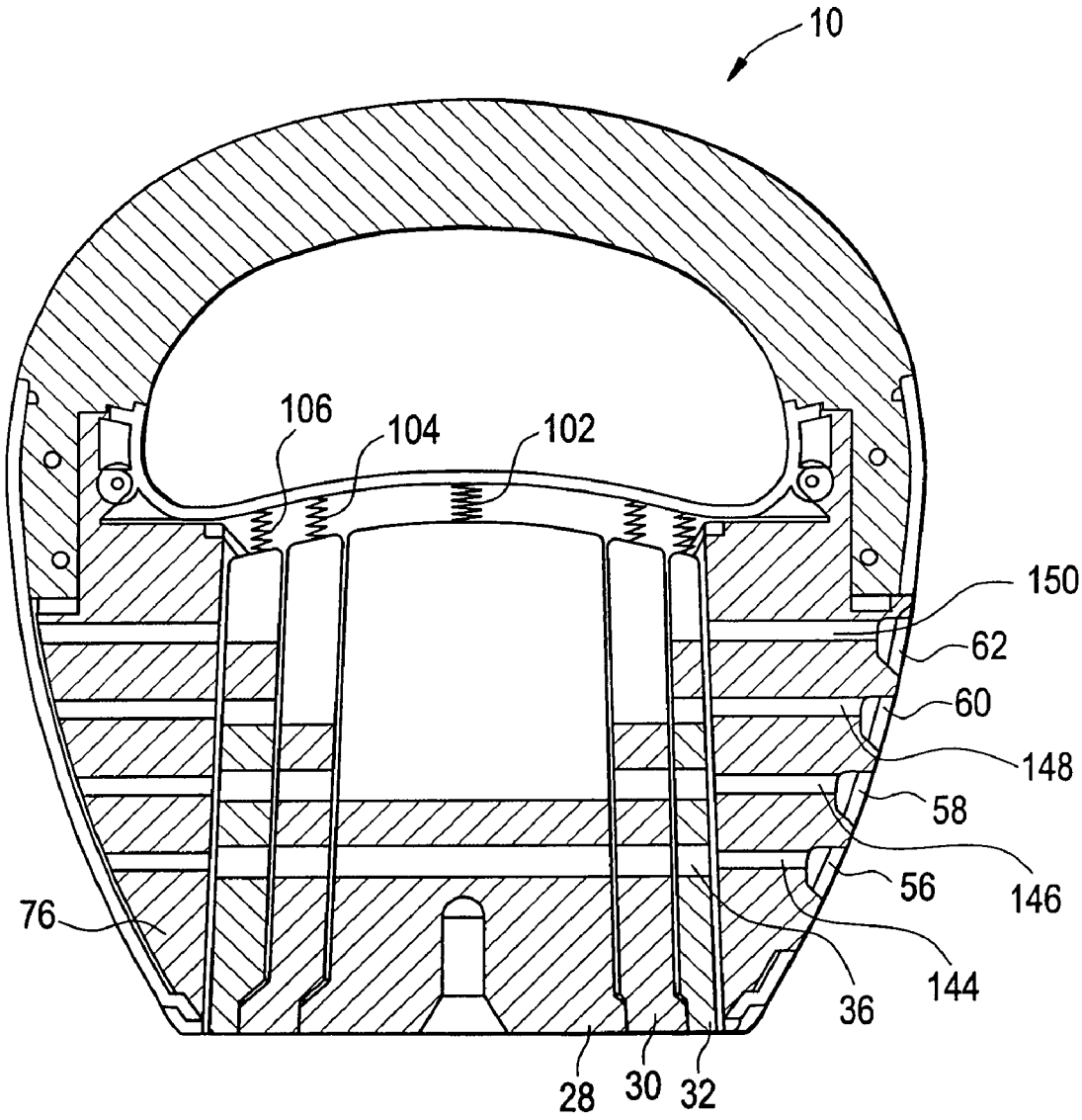
FIG. 5 is a front cross sectional view of the present exercise device.

Turning now to FIG. 5, taken along with FIG. 4, there is shown a cross sectional view of the present exercise device 10 and illustrating another locking means that is used to make up the dual locking system. In this view, there can be seen the receiving openings 56, 58, 60 and 62 that lead to bores 144, 146, 148 and 150 in the frame 76 and which bores then lead into the various holes in the weights 28, 30 and 32, as described, in order to attach one of more weights to the frame 76. Since the same principle applies to all of the bores 144, 146, 148 and 150, only one will be used as an example.

Taking, therefore the bore 144, when the locking pin 64 is nested into the receiving opening 56, the locking pin 64 passes into bore 144 and thence into the lower hole 36 of the outer weight 22. If the bore 144 and the lower hole 36 are perfectly aligned along their longitudinal axies, the locking pin 64 would pass easily from the bore 144 into the lower hole 36 without hindrance. With the present invention, however, the longitudinal axies of the bore 144 and the lower hole 36 are deliberately out of alignment, that is, when at rest, the longitudinal axis of the bore 144 is slightly higher then that of the lower hole 36. To make that alignment, it is necessary to move the bore 144 slightly downwardly with respect to the lower hole 36 against the bias of the sets of springs 102, 104 and 106.

That relative movement then can align the respective longitudinal axies of the bore 144 and the lower hole 36 to enable the locking pin 64 to be easily slid therein and, when released, the springs 102, 104 and 106 again create that misalignment so that there is a shear force exerted against the locking pin 64 by the misalignment of the bore 114 and the lower hole 36. That shear force serves to hold the locking pin 64 firmly in its inserted position wedged between the frame 76 and the outer weight 18 and, by the relative movement between the frame 76 and the weights 18, 20, 22, the locking and unlocking of the locking pin 64 can be carried out.

The relative movement that locks and unlocks the locking pin 64 is carried out by the present exercise device 10 automatically as it adds or takes away weights from and to the base 12 where the unused weights are normally stored.

Figure 6:
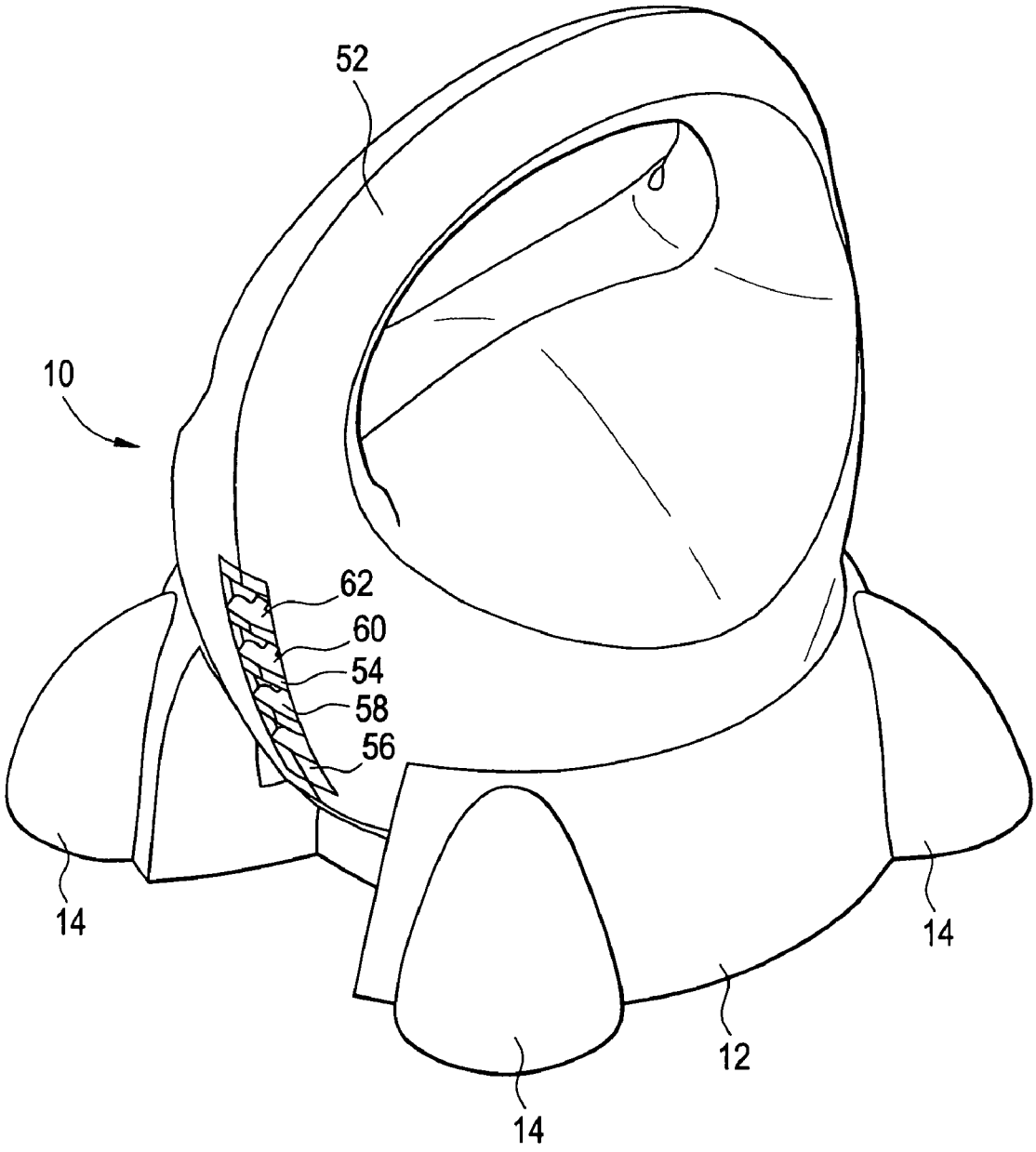
FIG. 6 is a perspective view of the present exercise device resting on the base.

Accordingly, referring to FIG. 6, taken along with FIGS. 1-3, it can be seen that the exercise device 10 is placed atop of the base 12 in order to add or remove weights. The unused weights are stored in the base 12 and retained in the proper alignment by the alignment pin 120. In order to pick up a weight from the base 12 or to deposit a weight on the base 12, the exercise device 10 is seated in the base 12 and rotated about an eighth of a turn. In doing so, the slanted locking projections 68 located at the bottom of the exercise device 10 engage with the locking edges 116 of the upstanding locks 114 on the base 12.

The rotation of the exercise device 10 serves to wedge the locking projections 68 underneath those locking edges 116 causing the frame 76 to be drawn downwardly. In the meantime, the weights are seated on the bottom of the base 12 and remain immovable. The lowering of the frame 76 thereby causes the relative movement between the frame 76 and the weights so as to align the longitudinal axies of, for example, bore 144 and the bottom hole 36 in the outer weight 22 to unlock the locking pin 64 and allow it to be easily withdrawn after prior unlocking of the toggle lever 66 as explained.

In addition, the downward motion of the frame 76 creates a force against the weights to expel the unattached weights from the exercise device 10 so that a weight or weights will not be hung up in the device and drop out inadvertently as eth user is performing an exercise. The downward force insures that the unused weight or weights has fully dropped out of the exercise device 10.

The reverse action relocks the locking pin 64 as the exercise device 10 is removed from the base 12 since the exercise device 10 must be rotated to release it from the base 12 and that rotation frees the locking projections 68 from the locking edges 116 of the upstanding locks 114, thereby allowing the bias of the springs to again create a misalignment of the axies of the bore 144 and the lower hole 36, for example, and clamp tightly again on the locking pin 64.

Figure 7:
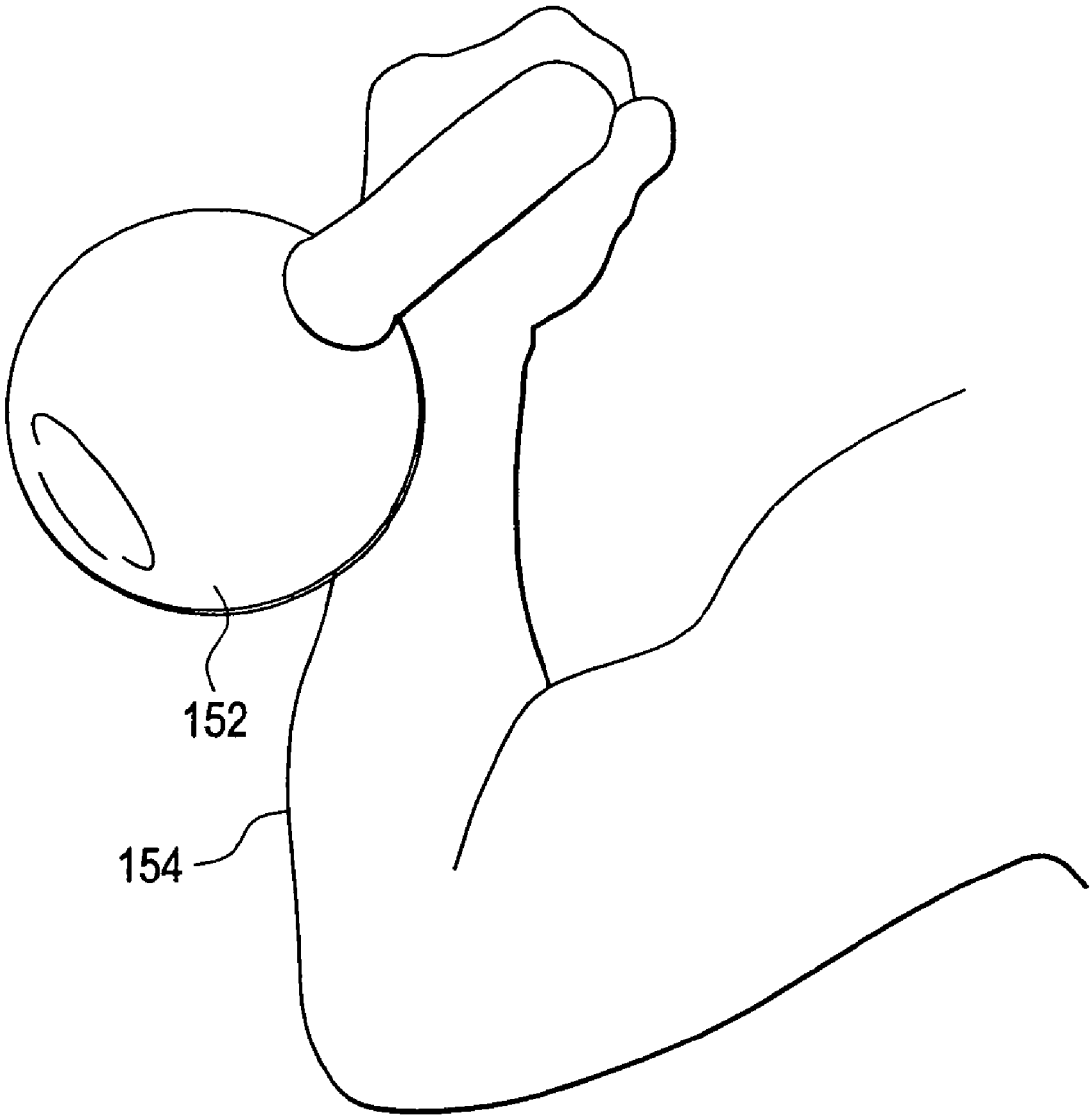
FIG. 7 PRIOR ART
FIG. 7 is a perspective view of a prior art exercise device in use.

Turning now to FIG. 7 there is a perspective view of a typical prior art kettlebell 152 having a generally spherical shape and, as can be seen, the kettlebell 152 has been flipped over by the users hand and is resting on the back of the wrist 154. With the shape of a sphere, the impact of the kettlebell 152 hitting the wrist is fairly traumatic and is uncomfortable and potentially painful, particularly with a new user trying to master the technique.

Figure 8:
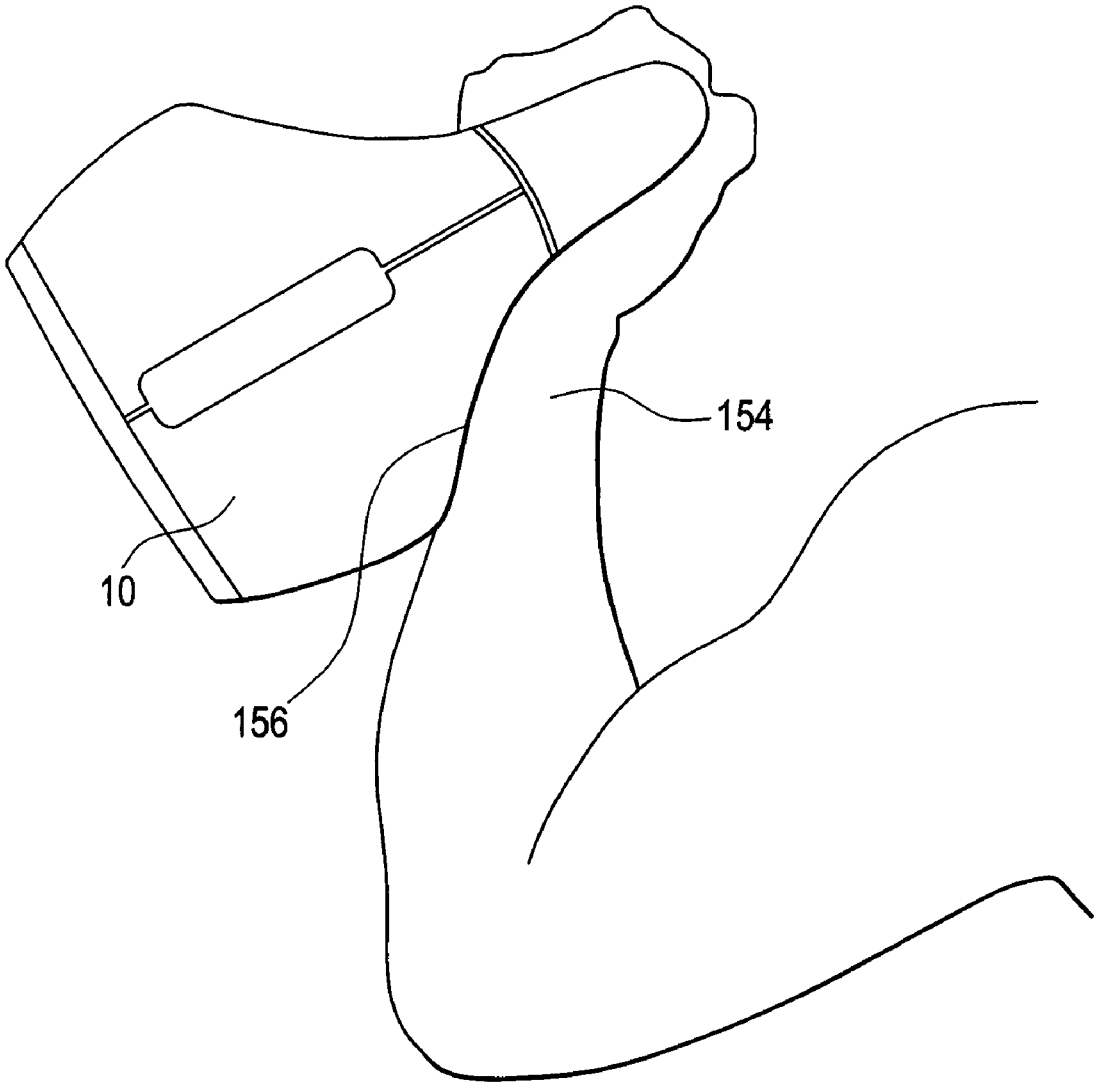
FIG. 8 is a perspective view of the present exercise device in use.

Turning then to FIG. 8, there is shown a perspective view illustrating the shape of the present exercise device 10. As can be seen the surface 156 of the exercise device 10 the contacts the back of the wrist 154 of the user is curved and generally fits comfortably along the wrist 154 of the user such that the impact with the wrist 154 is less traumatic and more comfortable for the user carrying out the exercise.

Figure 9B:
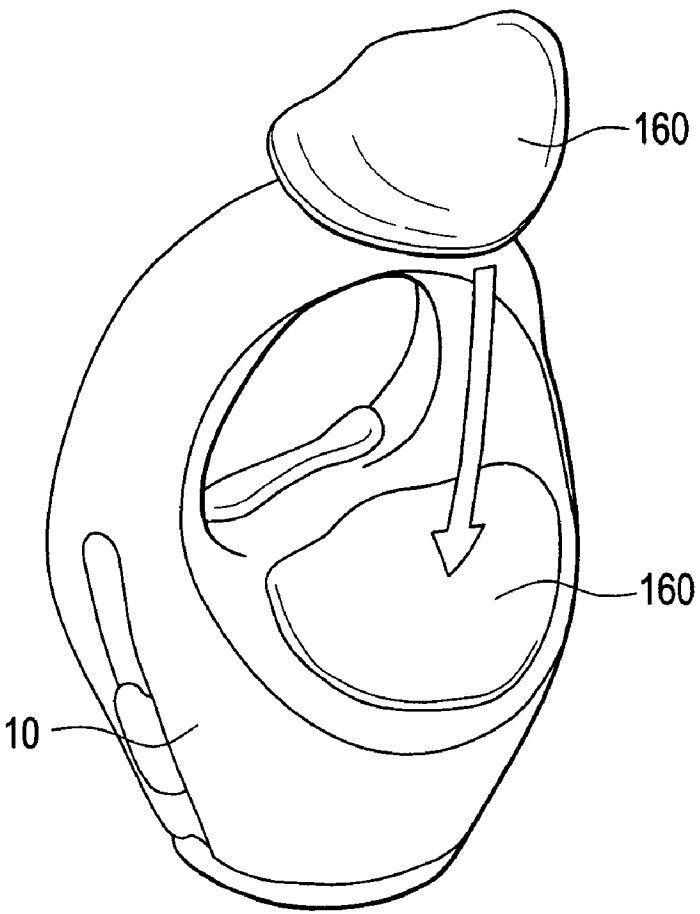
FIGS. 9A and 9B are perspective views of the present exercise device and illustrating pads that can be used therewith.
Figure 9A:
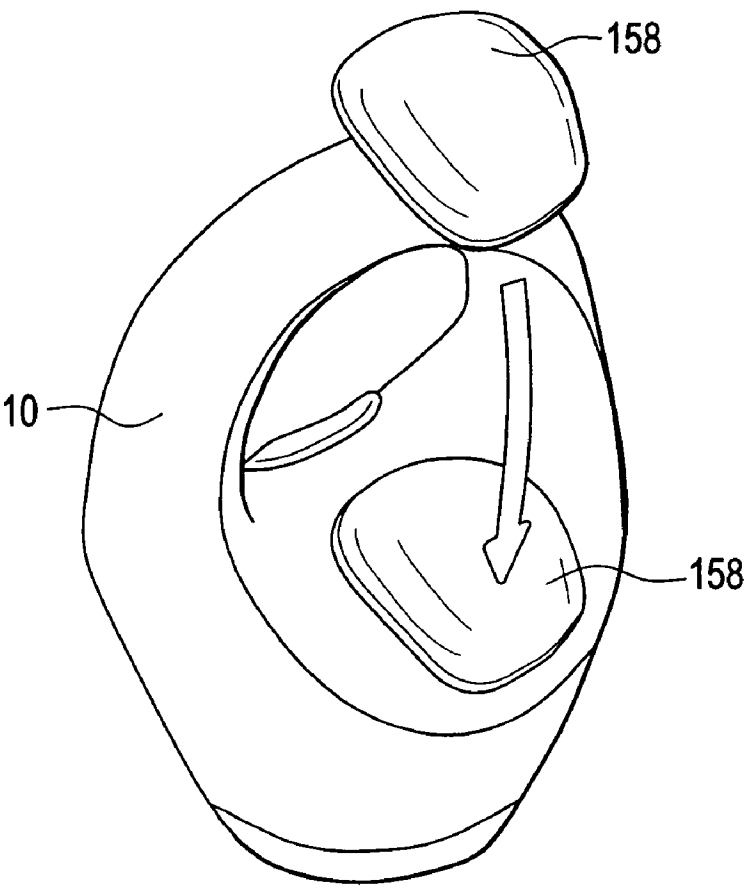

Finally tuning to FIGS. 9A and 9B there are perspective views of the present exercise device 10 with optional pads 158, 160 that can be applied to even more soften the impact between the exercise device 10 and the back of the user's wrist. The pad 158 can be die cut with cut square edges and can be applied to a reduced area at two locations on the exercise device 10. The pad 160 can be of a molded construction having a contoured shape with edges having a radius and can cover a broad area. In both of the pads 158, 160, the pads can be applied at the desired location by the user and can have a self-adhesive surface to facilitate that installation. As can be seen, the pads could be molded directly to the plastic shroud or be applied at the factory in some other manner and thus save the need for the user to add the pads to the exercise device 10.

Those skilled in the art will readily recognize numerous adaptations and modifications which can be made to the exercise device of the present invention which will result in an improved device and method of using the same, yet all of which will fall within the scope and spirit of the present invention as defined in the following claims. Accordingly, the invention is to be limited only by the following claims and their equivalents.

What is claimed is:

1. A hand held kettlebell exercise device comprising a frame forming an open area, a plurality of weights having predetermined shapes substantially enclosed within the open area of the frame, each of the weights having a central opening, the central opening of one weight being dimensioned to receive and surround another weight to nest together, a handle adapted to be grasped by a user in exercising with the device and a system to releasably and selectively attach one or more weights within the open area of the frame while maintaining the center of gravity of the weight substantially at a fixed point with respect to the handle, said system including a device that passes through the frame to selectively attach a desired number of weights to the frame and a shroud attached to the frame that at least substantially encloses the frame and weights attached thereto and forms the exterior configuration of the hand held kettlebell exercise device.

2. The exercise device of claim 1 wherein the plurality of weights each are generally annular in shape.

3. The exercise device of claim 1 wherein the weights can be added or subtracted from the device without altering the exterior configuration of the device.

4. The exercise device of claim 1 further including a base for retaining the device in a resting position, the base retaining the weights in a position to be selectively attached to the frame by means of the system to releasably and selectively attach one or more weights within the open area of the frame.

5. The exercise device of claim 4 wherein the base is configured to store the weights used with the device that are not selected by the system for releasably and selectively attaching one or more weights.

6. The exercise device of claim 1 wherein the individual weights are color coded and are visible when installed to the frame through an opening in the shroud.

7. The exercise device of claim 1 wherein the handle is a seamless, solid, one piece plastic grip that is rigid with respect to the frame.

8. A hand held kettlebell exercise device comprising a frame forming an open area, a plurality of weights selectively releasably attached to and substantially enclosed by the frame within the open area, a handle adapted to be grasped by a user in exercising with the device, a shroud attached to the frame that at least substantially encloses the frame and weights attached thereto and forms the exterior configuration of the hand held kettlebell exercise device, and an attaching and detaching system that includes a pin that passes through the frame and the shroud and automatically attaches one or more selected weights to the frame while releasing any non-selected weights from attachment to the frame.

9. The exercise device of claim 8 wherein the pin of the attaching and detaching system passes laterally through the frame and shroud.

10. The exercise device of claim 9 wherein the single pin is secured to the frame by a dual, independent locking system.

11. The exercise device of claim 1 further including pads that are affixed to the shroud and located on the shroud so as to reduce the impact of the device on the upper wrist and arm of the user.

12. A hand held kettlebell exercise device wherein the device is adapted to rest atop of the arm of a user in carrying out an exercise, the device comprising a frame, at least one weight releasably attached to the frame, a handle adapted to be grasped by a user in exercising with the device, the device having a curved area adapted to contact and fit complementary to the back of an arm of a user when the kettlebell exercise device is in position resting atop of the arm of a user.

13. The hand held exercise device as defined in claim 12 wherein the device includes a shroud covering at a least a portion of the frame and the curved area is formed in the shroud.

14. A hand held kettlebell exercise device comprising a frame, a plurality of weights selectively releasably attached to the frame, a handle adapted to be grasped by a user in exercising with the device, and an attaching and detaching system that automatically attaches one or more selected weights to the frame while releasing any non-selected weights from attachment to the frame, and a shroud attached to the frame that at least substantially encloses the frame and weights attached thereto and forms the exterior configuration of the hand held kettlebell exercise device wherein the attaching and detaching system includes a single pin that selectively attaches a desired number of weights to the frame.

15. The exercise device of claim 14 wherein the single pin is secured to the frame by a dual locking system.

16. A hand held kettlebell exercise device comprising a frame forming an open area, a plurality of weights having predetermined shapes to fit within the open area of the frame, a handle adapted to be grasped by a user in exercising with the device and a system to releasably and selectively attach one or more weights within the open area of the frame while maintaining the center of gravity of the weight substantially at a fixed point with respect to the handle, said system including a device that passes through the frame to selectively attach a desired number of weights to the frame and a shroud attached to the frame that at least substantially encloses the frame and weights attached thereto and forms the exterior configuration of the hand held kettlebell exercise device, the device further including a base for retaining the device in a resting position, the base retaining the weights to be selectively attached to the frame and being configured to store the weights used with the device that are not selected by the system for releasably and selectively attaching one or more weights.

* * * * *